US006080214A

United States Patent [19]

Mungia

[11] Patent Number: 6,080,214

[45] Date of Patent: Jun. 27, 2000

[54] SELF-CONTAINED CHARCOAL STARTER

[76] Inventor: Jesse Mungia, P.O. Box 695, Gonzales, La. 70707-0695

[21] Appl. No.: 09/150,548

[22] Filed: Sep. 9, 1998

[51] Int. Cl.[7] ..... C10L 11/00

[52] U.S. Cl. ..... 44/530; 206/96

[58] Field of Search ..... 44/530

[56] References Cited

U.S. PATENT DOCUMENTS

| | | | |
|---|---|---|---|
| 179,165 | 6/1876 | Dalzell | 431/321 |
| 753,779 | 3/1904 | Woodman | 206/101 |
| 825,372 | 7/1906 | Beever | 206/102 |
| 1,418,217 | 5/1922 | Warner | 206/101 |
| 1,468,742 | 9/1923 | Peckes | 206/90 |
| 1,587,468 | 6/1926 | Burkey et al. | 206/269 |
| 1,835,749 | 12/1931 | Behrman | 150/106 |
| 2,537,332 | 1/1951 | Clampitt | 206/101 |
| 3,028,228 | 4/1962 | Chaplin | 44/530 |
| 4,108,611 | 8/1978 | Youdelman | 44/507 |
| 4,175,925 | 11/1979 | Paek et al. | 44/540 |
| 4,478,601 | 10/1984 | Stephens | 44/530 |
| 4,782,812 | 11/1988 | Kellerman | 44/530 |
| 4,899,721 | 2/1990 | Tsay | 126/25 B |
| 5,279,628 | 1/1994 | Hutchens et al. | 44/507 |
| 5,830,245 | 11/1998 | Raddon | 44/544 |

*Primary Examiner*—Ellen M. McAvoy
*Attorney, Agent, or Firm*—Reginald F. Roberts, Jr.

[57] ABSTRACT

A self-contained charcoal starter for barbecuing. The self-contained charcoal starter includes a bag containing charcoal briquettes and a box or book of matches. The box or book of matches is attached to the inside of the bag by an adhesive. When the fire is to be started, the briquettes are deposited in a barbecue pit, and the box or book of matches is detached from the bag and used to ignite the charcoal.

21 Claims, 2 Drawing Sheets

SELF-CONTAINED CHARCOAL STARTER

BACKGROUND OF THE INVENTION

The present invention relates to a barbecue pit. More particularly, the invention relates to a packet for igniting charcoal in a barbecue pit.

More often than not, a person intent on barbecuing hamburgers, chicken, or similar food is all ready to get started and then—forgets the matches! The present invention solves this problem by providing a packet which is sufficient, in and by itself, to start a barbecue fire.

U.S. Pat. No. 4,899,721 to Tsay discloses a charcoal stove casing set which is adapted for preparation of barbecue and for household fireplace application.

U.S. Pat. No. 825,372 to Beever discloses a combined match box and oil can adapted to be strapped to the waist of a miner.

U.S. Pat. No. 753,779 to Woodman discloses a glove to be worn while striking a match.

U.S. Pat. No. 1,418,217 to Warner discloses a match holder for hats.

U.S. Pat. No. 2,537,332 to Clampith discloses a watertight cigarette and match case.

U.S. Pat. No. 1,835,749 to Behrman discloses a lady's pocketbook for holding cigarette cases and a cigarette lighter.

U.S. Pat. No. 179,165 to Dalzell discloses a match-box attachment for lamps adapted to lighting the lamps.

U.S. Pat. No. 1,587,468 to Burkey et al. discloses a watertight case for holding cigarettes and matches.

U.S. Pat. No. 1,468,742 to Peckes discloses a watertight container for cigarettes, confections, chewing gum, and the like.

A kit sold as "CHARCOAL COMPANION" provides the purchaser with a barbecue grill and various sauces, but not with any means such as matches for starting a barbecue fire.

Thus, none of the prior art provides the public with a packet which is simple, accessible, and self-sufficient for the immediate preparation of a charcoal barbecue in a barbecue pit. The present invention provides such a packet.

SUMMARY OF THE INVENTION

In general, the present invention in a first aspect provides a self-contained charcoal starter. The charcoal starter comprises (a) a first container having inner and outer surfaces; (b) a second container disposed in the first container; (c) ignition means disposed in the second container; and (d) combustible material ignitable by the ignition means, disposed in the first container. A portion of the second container is adhesively attached to the inner surface of the first container.

In a second aspect the invention provides a method for converting a bag of charcoal briquettes into a self-contained charcoal starter. The method comprises (a) disposing in a container means for igniting the charcoal; and (b) adhesively attaching the container to the inside of the bag.

In a third aspect the present invention provides a self-contained charcoal starter comprising (a) a container having inner and outer surfaces; (b) ignition means adhesively attached to the inner surface of the container; and (c) combustible material ignitable by the ignition means, disposed in the container.

In a fourth aspect the invention provides a method for converting a bag of charcoal briquettes into a self-contained charcoal starter, which comprises adhesively attaching to the inside of the bag means for igniting the charcoal.

DETAILED DESCRIPTION OF THE INVENTION

A first embodiment of the present invention provides a self-contained barbecue starter in which a box or book containing a match or a plurality of matches is adhesively attached to the inside of a bag containing charcoal.

In a second embodiment a box containing a match or a plurality of matches is contained by a sheet adhesively attached to the inside of the bag. The box may optionally be adhesively attached to the inside of the bag, as in the first embodiment.

In a third embodiment a sheet adhesively attached to the inside of the bag is used to contain a match or a plurality of matches.

In a fourth embodiment a match is adhesively attached to the inside of the bag.

Figure 1:
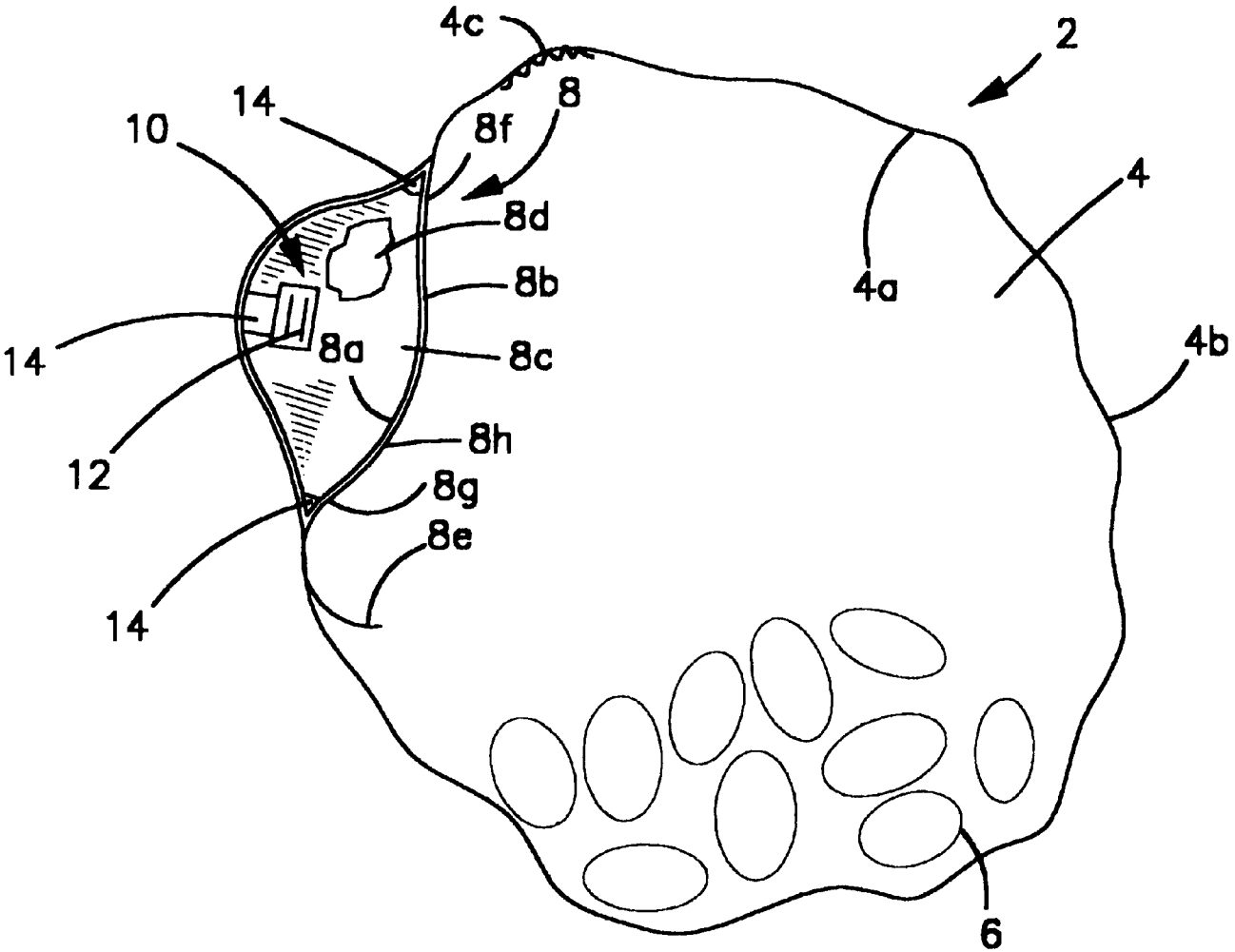
FIG. 1 is a schematic representation of three embodiments of a self-contained charcoal starter, made in accordance with the principles of the present invention.
Figure 2:
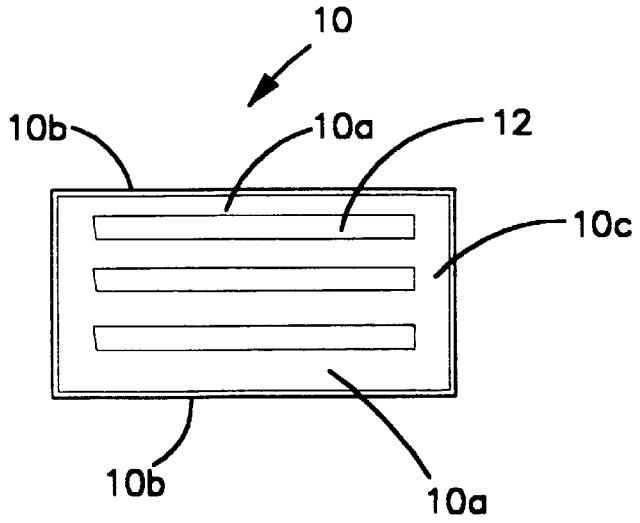
FIG. 2 is a schematic representation of a box of matches, viewed from above.
Figure 3:
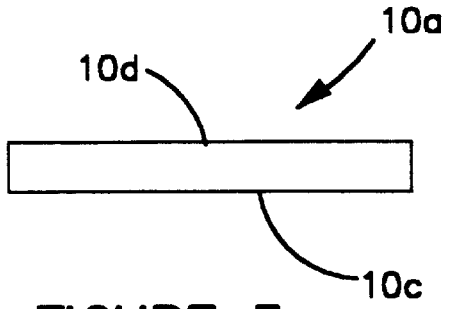
FIG. 3 is a schematic representation of one of the sides of the box of matches.

More specifically, reference is made to FIGS. 1–3, in which are shown the elements of the first, second, and third embodiments of a self-contained charcoal starter, made in accordance with the principles of the present invention, and generally designated by the numeral 2.

As shown in FIG. 1, the charcoal starter 2 comprises a bag 4, which is preferably a flexible paper or plastic bag which may be sealed by, e.g., stitches 4*c*. The bag 4 contains a supply of charcoal, preferably in the form of charcoal briquettes 6, suitable for use in a barbecue pit. The bag 4 includes an inner surface 4*a* and an outer surface 4*b*. The bag 4 is usually cut open with scissors or torn open, then closed by means of a chip clip or by rolling up the top portion of the bag 4.

To an upper portion of the inner surface 4*a* of the bag 4 is attached a sheet 8 having an inner surface 8*a*, an outer surface 8*b*, an upper edge 8*f*, a lower edge 8*g*, a first lateral edge 8*c*, and a second lateral edge 8*d*. The lower edge 8*g* has an upper portion 8*h* and a lower portion 8*e*. At least a portion of the upper edge 8*f*, of each lateral edge 8*c*, 8*d*, and of the upper portion 8*h* of the lower edge 8*g* are attached to the inner surface 4*a* of the bag 4 by an adhesive material 14. At least part of the lower portion 8*e* of the lower edge 8*g* may optionally not be attached to the bag 4, thereby forming a flap which can be grasped and pulled away from the inner surface 4*a* of the bag 4, to provide means for detaching and/or opening the sheet 8.

The sheet 8 contains means for lighting the charcoal 6. The ignition means may be simply a match 12 or a plurality of matches 12. Preferably, however, the matches 12 are enclosed and contained in and by a box or book 10 which is preferably attached to an upper portion of the inner surface 4*a* of the bag 4 by an adhesive material 14.

Reference is now made to FIG. 2, in which is shown the detailed structure of a match box 10. The match box 10, which contains matches 12 in a slidable tray 10*c*, has a first pair of sides 10*a* which are parallel to one another, and a second pair of sides 10*b* which are parallel to one another and perpendicular to the first pair of sides 10*a*. The sides 10*a* and 10*b* are of approximately the same length, but the first pair of sides 10*a* are substantially wider than the second pair of sides 10*b*. At least a portion of one of the first pair of sides 10*a* is adhesively attached to the inner surface 4*a* of the bag.

Reference is now made to FIG. 3, in which are shown inner 10*c* and outer 10*d* surfaces of one of the pair of sides 10*a*. It is of course the outer surface 10*d* of the side 10*a* which is adhesively attached to the inner surface 4*a* of the bag 4.

Figure 4:
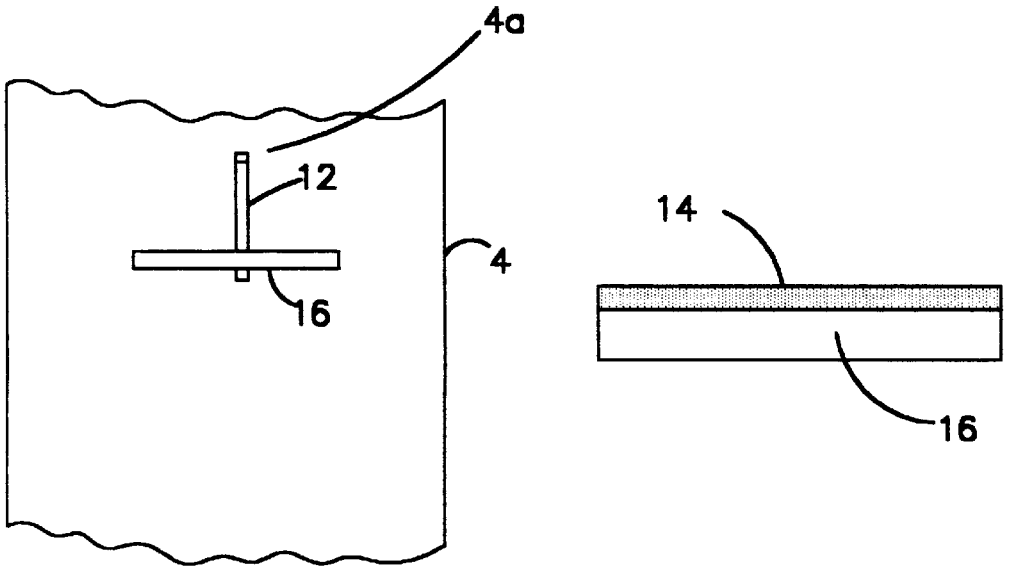
FIG. 4 is a schematic representation of a portion of a fourth embodiment of a self-contained charcoal starter, made in accordance with the principles of the present invention.

Reference is now made to FIG. 4, in which is shown a portion of a fourth embodiment of a self-contained charcoal starter, made in accordance with the principles of the present invention. In this embodiment a match 12 is adhesively attached to an upper portion of the inner surface 4*a* of the bag 4, using a strip 16 provided with a layer of an adhesive material 14. The match 12 is accessible by pulling off the strip 16, or a sufficient portion thereof, to recover the match 12. The remainder of the structure and method of using the fourth embodiment of the self-contained charcoal starter 2 is similar to the structure and method of using the first three embodiments of the self-contained charcoal starter 2.

It will be apparent to those skilled in the art that, in the fourth embodiment of the self-contained charcoal starter 2, the adhesive material 14 could be applied directly to the match 12, as in the first three embodiments of the invention. It will be equally apparent that, in the first three embodiments of the self-contained charcoal starter 2, the adhesive-coated strip 16 could be used instead of applying the adhesive material 14 directly to the box 10 or to the sheet 8.

When someone using the charcoal starter 2 is ready to fire up a barbecue pit, there are several ways which may be used to retrieve a match 12 or box or book of matches 10 from the sheet 8. He or she may do so by tearing open the front portion of the sheet 8, or by pulling on the flap 8*e*. Alternately, the sheet 8 may be detached from the bag 4, and then torn open. If the matches 12 are loosely disposed within the sheet 8, they will fall and can be recovered. If the matches 12 are enclosed as a box or book of matches 10, the box or book of matches 10 can be recovered in a similar manner, if they are not attached to the inner surface 4*a* of the bag 4. If the box or book of matches 10 is adhesively attached to the inner surface 4*a* of the bag 4, the box or book of matches 10 can be recovered by pulling the box or book of matches 10 away from the inner surface 4*a* of the bag 4 to which the box or book of matches 10 is attached. The individual matches 12 are then readily accessible by sliding the tray 10*c* through the opening at either end of the box of matches 10.

If only the box or book of matches 10 is used and the sheet 8 omitted, as in the first embodiment of the charcoal starter 2, the user need only pull the box or book of matches 10 away from the inner surface 4*a* of the bag 4, and retrieve a match 12 for igniting the charcoal 6.

The use of an adhesive is crucial to the present invention. It provides simple, fast, and reversible attachment and detachment of the box or book of matches 10 to and from the bag 4. Mechanisms disclosed by the prior art for providing ignition means are, by comparison, complex, cumbersome, and slow.

For example, Tsay teaches the use of a presspaper casing provided with a solid-alcohol trough and a match-stick fire assembly for his charcoal stove casing set. For his combined match box and oil can, Beever discloses a match box provided with a screw-threaded portion which is adapted to engage a screw-threaded portion of a socket. For his match box attachment for lamps Dalzell uses a match box sunk within the bowl of a lamp. The match box forms a tight threaded joint with the collar of a filling orifice, and is provided with a hinged or screw cap.

It will be apparent to those skilled in the art that mechanisms like those described above and disclosed by the prior art are unsuitable and impractical for a charcoal starter comprising a bag containing charcoal and a match or box or book of matches for igniting the charcoal.

While certain details and embodiments have been described to illustrate the principles of the present invention, it will be apparent to those skilled in the art that many modifications can and may be made therein without departing from the spirit, scope, and basic concept of the invention. For example, wood chips or small wooden logs, scented or unscented, are packaged and sold for use in fireplaces or for other applications. It will be apparent to those skilled in the art that the use of wood chips or wooden logs rather than charcoal clearly lies within the scope of the present claimed invention.

I claim:

1. A self-contained charcoal starter, comprising:

(a) a first container having inner and outer surfaces;

(b) a second container disposed within the first container, a portion of the second container being adhesively attached to the inner surface of the first container;

(c) ignition means disposed within the second container; and (d) combustible material ignitable by the ignition means, disposed within the first container.

2. The self-contained charcoal starter of claim 1, wherein:

the first container is a bag;

the second container is a book or box; and the ignition means include a match disposed in the book or box.

3. The self-contained charcoal starter of claim 1, wherein:

the first container is a bag;

the second container is a sheet having upper and lower edges and first and second lateral edges;

at least a portion of the upper edge, of the lower edge, and of each lateral edge of the sheet is adhesively attached to the inner surface of the bag; and the ignition means include a match disposed within the second container.

4. The self-contained charcoal starter of claim 3, further comprising:

(e) a box or book in which the match is disposed, the box being disposed within the sheet.

5. The self-contained charcoal starter of claim 3, further comprising:

(e) a box or book in which the match is disposed, the box or book being disposed within the sheet and adhesively attached to the inner surface of the bag.

6. The self-contained charcoal starter of claim 3, wherein:

the lower edge of the sheet includes upper and lower portions;

at least a portion of the upper portion of the lower edge of the sheet is adhesively attached to the inner surface of the bag; and at least a portion of the lower portion of the lower edge of the sheet is free, forming a flap which can be grasped and pulled away from the inner surface of the bag to which the sheet is attached, thereby opening the sheet.

7. The self-contained charcoal starter of claim 6, further comprising:

(e) a box or book in which the match is disposed, the box or book being disposed within the sheet.

8. The self-contained charcoal starter of claim 6, further comprising:

(e) a box or book in which the match is disposed, the box or book being disposed within the sheet and adhesively attached to the inner surface of the bag.

9. The self-contained charcoal starter of claim 2, wherein:

the combustible material is charcoal.

10. A method for converting a bag of charcoal briquettes into a self-contained charcoal starter, the method comprising the steps of:

(a) disposing in the bag means for igniting the charcoal; and (b) adhesively attaching the container to the inside of the bag.

11. The method of claim 10, wherein:

the container is a book or box; and the ignition means include a match.

12. The method of claim 10, wherein:

the ignition means is a match;

the container is a sheet having upper and lower edges and first and second lateral edges; and at least a portion of the upper edge, of the lower edge, and of each lateral edge of the sheet is adhesively attached to the inside of the bag.

13. The method of claim 12, wherein:

the match is disposed in a book or box.

14. The method of claim 12, wherein:

the match is disposed in a box or book adhesively attached to the inside of the bag.

15. The method of claim 12, wherein:

the lower edge of the sheet includes upper and lower portions;

at least a portion of the upper portion of the lower edge of the sheet is adhesively attached to the inside of the bag; and at least a portion of the lower portion of the lower edge of the sheet is free, forming a flap which can be grasped and pulled away from the inside of the bag to which the sheet is attached, thereby opening the sheet.

16. The method of claim 15, wherein:

the match is disposed in a book or box; and the book or box is disposed in the sheet.

17. The method of claim 15, wherein:

the match is disposed in a book or box;

the book or box is disposed in the sheet; and the box or book is adhesively attached to the inside of the bag.

18. A self-contained charcoal starter, comprising:

(a) a container having inner and outer surfaces;

(b) ignition means adhesively attached to the inner surface of the container; and (c) combustible material ignitable by the ignition means, disposed in the container.

19. The self-contained charcoal starter of claim 18, wherein:

the container is a bag;

the ignition means is a match; and the combustible material is charcoal.

20. A method for converting a bag of charcoal briquettes into a self-contained charcoal starter, which method comprises adhesively attaching to the inside of the bag means for igniting the charcoal.

21. The method of claim 20, wherein the ignition means is a match.

* * * * *